US009748649B2

(12) United States Patent
Park et al.

(10) Patent No.: US 9,748,649 B2
(45) Date of Patent: Aug. 29, 2017

(54) ANTENNA MODULE AND ELECTRONIC APPARATUS INCLUDING THE SAME

(71) Applicant: Samsung Electronics Co., Ltd, Suwon-si, Gyeonggi-do (KR)

(72) Inventors: Min-seok Park, Seoul (KR); Chee-hwan Yang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 268 days.

(21) Appl. No.: 13/908,193

(22) Filed: Jun. 3, 2013

(65) Prior Publication Data

US 2014/0168021 A1 Jun. 19, 2014

(30) Foreign Application Priority Data

Dec. 18, 2012 (KR) ..... 10-2012-0148359

(51) Int. Cl.

| | |
|---|---|
| ***H01Q 5/10*** | (2015.01) |
| ***H01Q 1/36*** | (2006.01) |
| ***H01Q 1/44*** | (2006.01) |
| ***H01Q 21/28*** | (2006.01) |

(52) U.S. Cl.

CPC ..... *H01Q 5/10* (2015.01); *H01Q 1/36* (2013.01); *H01Q 1/44* (2013.01); *H01Q 21/28* (2013.01)

(58) Field of Classification Search

CPC H01Q 1/243; H01Q 1/36; H01Q 1/44; H01Q 5/10; H01Q 21/28; H01Q 23/00; H01Q 1/40; H01Q 9/0407; H01Q 9/0421; H01Q 9/16; H01Q 9/30; H01Q 1/24; H01Q 5/321; H01Q 5/328; H01Q 5/00; H01Q 1/088; H01Q 1/241; H01Q 1/242; H05K 3/4015; H05K 5/0221; H05K 1/0284; H05K 3/182; H04B 1/3833; H04B 1/0483; H04B 2001/0491; H01R 12/57; H01R 2201/02; H01R 13/24; H01R 4/64; H01R 12/718; H01R 2201/00; H01R 2201/021; G02F 1/133308; G02F 2001/133334; Y02B 60/50; G06F 1/1698; H01F 1/26; H04M 1/026; F16B 9/023; F16B 21/08

USPC ..... 343/702, 749, 906, 872, 904, 700 MS; 455/572

See application file for complete search history.

(56) References Cited

U.S. PATENT DOCUMENTS 4,868,576 A * 9/1989 Johnson, Jr. ..... H01Q 1/243 343/702
5,262,792 A * 11/1993 Egashira ..... 343/702
5,822,705 A * 10/1998 Lehtola ..... H01Q 1/242 343/702
5,977,928 A * 11/1999 Ying ..... H01Q 1/24 343/702

(Continued)

OTHER PUBLICATIONS

The ARRL Antenna Book, published by the American Radio Relay League.*
The ARRL Antenna Book, by The American Radio Relay League.*

*Primary Examiner* — Jessica Han
*Assistant Examiner* — Awat Salih
(74) *Attorney, Agent, or Firm* — Staas & Halsey LLP

(57) ABSTRACT

An antenna module and an electronic apparatus include: an antenna element, and a clip which includes an antenna pattern, is formed of a metallic material, and electrically connects the antenna element to a circuit board to process an antenna signal through the antenna pattern.

14 Claims, 10 Drawing Sheets

(56) References Cited

U.S. PATENT DOCUMENTS 6,198,444 B1 * 3/2001 Sailsman ..... H01Q 1/244 343/702
6,285,324 B1 * 9/2001 Korisch ..... H01Q 1/243 333/26
6,423,915 B1 * 7/2002 Winter ..... H01Q 1/243 200/292
7,113,135 B2 * 9/2006 Jo ..... H01Q 1/242 343/700 MS
7,932,864 B2 * 4/2011 Zhu et al. ..... 343/702
8,077,097 B2 * 12/2011 Chung ..... H01Q 1/2291 343/702
2001/0050647 A1 * 12/2001 Kanayama ..... H01Q 1/243 343/702
2003/0016177 A1 * 1/2003 Deguchi ..... H01Q 1/242 343/702
2007/0205947 A1 * 9/2007 Boyle ..... H01Q 1/243 343/700 MS
2007/0241971 A1 * 10/2007 Tsujimura ..... G06F 1/1616 343/702
2009/0160718 A1 * 6/2009 Yen et al. ..... 343/742
2009/0213030 A1 * 8/2009 Hynes ..... H01Q 1/243 343/906
2009/0219215 A1 * 9/2009 Huber ..... H01Q 1/243 343/702
2009/0303139 A1 * 12/2009 Schlub et al. ..... 343/702
2010/0039780 A1 * 2/2010 Wendt ..... H01R 12/79 361/752
2011/0156967 A1 * 6/2011 Oh ..... H01Q 9/40 343/702
2011/0279331 A1 * 11/2011 Mattis ..... H01Q 1/02 343/702
2011/0286174 A1 * 11/2011 Na ..... H01Q 1/243 361/679.41
2011/0316754 A1 * 12/2011 Nam ..... H01Q 1/243 343/702
2012/0001826 A1 * 1/2012 Achour ..... H01Q 9/0428 343/905
2012/0032858 A1 * 2/2012 Chang ..... B29C 45/1671 343/702
2012/0068893 A1 * 3/2012 Guterman ..... H01Q 1/2266 343/702
2012/0168517 A1 * 7/2012 Lee ..... H01Q 1/243 235/492
2013/0249744 A1 * 9/2013 Jang ..... H01Q 21/30 343/702
2014/0049445 A1 * 2/2014 Tu ..... H01Q 1/2291 343/893
2014/0118196 A1 * 5/2014 Koskiniemi ..... H01Q 1/42 343/702
2014/0132460 A1 * 5/2014 Cho ..... H01Q 1/243 343/702

* cited by examiner

ANTENNA MODULE AND ELECTRONIC APPARATUS INCLUDING THE SAME

CROSS-REFERENCE TO RELATED APPLICATIONS

This application claims priority under 35 U.S.C. §119 from Korean Patent Application No. 10-2012-0148359, filed on Dec. 18, 2012, in the Korean Intellectual Property Office, the disclosure of which is incorporated herein by reference in its entirety.

BACKGROUND OF THE INVENTION

1. Field of the Invention

The present general inventive concept generally relates to an antenna module and an electronic apparatus including the same, and more particularly, to an antenna module which connects an antenna and a circuit board to each other by using a clip having a pattern to improve a characteristic of the antenna, and an electronic apparatus including the same.

2. Description of the Related Art

The rapid development of digital communication technology has brought the development of a mobile communication terminal apparatus which provides various types of services such as a Long Term Evolution (LTE), a global positioning system (GPS), a near field communication (NFC), a wireless local area network (WLAN), etc.

The mobile communication terminal apparatus includes an antenna which transmits and receives a wireless signal. The antenna is classified into an external antenna and an internal antenna according to arrangements of the antenna. The internal antenna has been more widely used than the external antenna due to a damage risk of an external antenna and a design demand of electronic apparatuses.

A C-clip has been used to feed power to the internal antenna. However, the C-clip performs only a function of feeding power to an emitter and has a great size, and thus it is difficult to make the electronic apparatus small. Also, if the electronic apparatus is to include a plurality of antennas, a plurality of C-clips is used, thus further increasing the size of the electronic apparatus. Therefore, the C-clip is to be improved.

SUMMARY OF THE INVENTION

The present general inventive concept provides an antenna module which connects an antenna and a circuit board to each other by using a clip having a pattern to improve a characteristic of the antenna, and an electronic apparatus including the same.

Additional features and utilities of the present general inventive concept will be set forth in part in the description which follows and, in part, will be obvious from the description, or may be learned by practice of the general inventive concept.

Exemplary embodiments of the present general inventive concept provide an antenna module including an antenna element, and a clip which includes a clip antenna pattern, is formed of a metallic material, and electrically connects the antenna element to a circuit board to process an antenna signal through the antenna pattern.

The clip antenna pattern may have at least one of a meandering shape, a symmetrical shape, and a spiral shape.

The antenna element may resonate in a first frequency band, and the clip antenna pattern may resonate in a second frequency band.

The first frequency band may be 2.4 GHz, and the second frequency band may be 5 GHz.

The antenna element may include a body block, and a block antenna pattern which is formed on a surface of the body block and is connected to the clip.

The block antenna pattern may be formed on a plurality of surfaces of the body block.

A total length of the block antenna pattern may be ¼ times of a wavelength length of a first frequency band.

A total length of the block antenna pattern and the clip antenna pattern may be ¼ times of a wavelength of a first frequency band.

The clip may have a C shape.

The antenna element may have a dipole antenna pattern.

Exemplary embodiments of the present general inventive concept provide an electronic apparatus including a communication interface which includes an antenna module and a circuit board to communicate with an external apparatus through the antenna module. The antenna module may include an antenna element, and a clip which includes a clip antenna pattern, is formed of a metallic material, and electrically connects the antenna element to the circuit board.

The clip antenna pattern may have at least one of a meandering shape, a symmetrical shape, and a spiral shape.

The antenna element may resonate in a first frequency band, and the clip antenna pattern may resonate in a second frequency band.

The first frequency band may be 2.4 GHz, and the second frequency band may be 5 GHz.

The antenna element may include a body block, and a block antenna pattern which is formed on a surface of the body block and is connected to the clip.

The block antenna pattern may be formed on a plurality of surfaces of the body block.

A total length of the block antenna pattern may be ¼ times of a wavelength length of a first frequency band.

A total length of the block antenna pattern and the clip antenna pattern may be ¼ times of a wavelength of a first frequency band.

The clip may have a C shape.

The antenna element may have a dipole antenna pattern.

The clip may comprise a plurality of connection positions which electrically connect the antenna element to the circuit board.

Exemplary embodiments of the present general inventive concept provide an antenna unit including a circuit board, and an antenna module including an antenna element, and a clip which includes a clip antenna pattern, is formed of a metallic material, and electrically connects the antenna element to the circuit board at at least two connection positions to process an antenna signal through the antenna pattern, wherein power is selectively supplied to the antenna element through one of the at least two connection positions.

A resonant frequency of the antenna unit may be changed according to which connection position power is supplied through.

A sum of a length of the antenna element and a length of the antenna pattern may be ¼ times a wavelength of a first frequency band.

A length of the antenna pattern may be ¼ times of a wavelength of a second frequency band having a higher frequency than the first frequency band.

A length of the antenna element may be ¼ times of a wavelength of a third frequency band having a higher frequency than the first frequency band and a lower frequency than the second frequency band.

One of the at least two connection positions may cause the antenna unit to have a plurality of resonant frequencies when power is supplied through the connection position.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
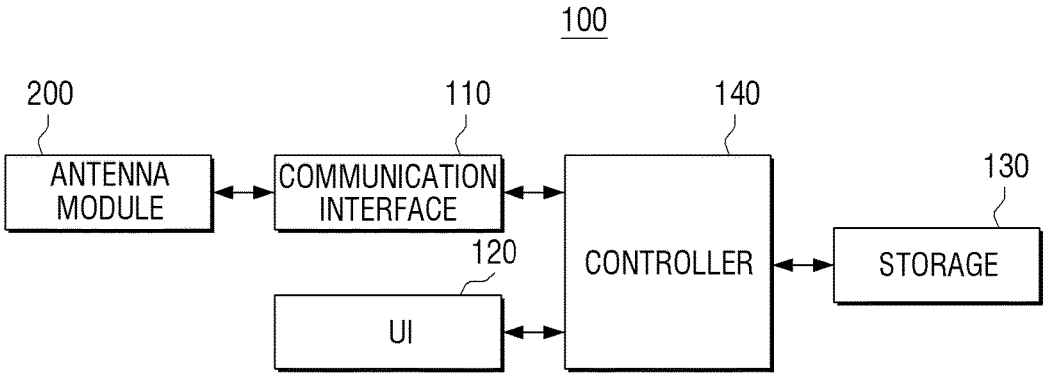
FIG. 1 is a block diagram illustrating a structure of an electronic apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a block diagram illustrating a structure of an electronic apparatus 100 according to an exemplary embodiment of the present general inventive concept;

Referring to FIG. 1, the electronic apparatus 100 includes a communication interface 110, a user interface (UI) 120, a storage 130, a controller 140, and an antenna module 200. Here, the electronic apparatus 100 is an apparatus, such as a PC, a notebook PC, a tablet PC, a portable multimedia player (PMP), a smart phone, or the like, which communicates with an external apparatus (not shown) by using the antenna module 200.

The communication interface 110 is formed to connect the electronic apparatus 100 to the external apparatus and may be connected to the external apparatus through a local area network (LAN) and the Internet or may be connected to the external apparatus through a wireless communication (e.g., GMS, a Universal Mobile Telephone System (UMTS), LTE, WiBRO, WiFi, Bluetooth, or the like) by using the antenna module 200.

The communication interface 110 includes a circuit board 105 (illustrated in FIG. 3) on which the antenna module 200 is disposed. Here, the circuit board 105 is electrically connected to a clip 220 of the antenna module 200, and supplies electromagnetic energy to the antenna module 200. In the present exemplary embodiment, the communication interface 100 includes the circuit board 105, i.e., only the communication interface 110 is disposed on the circuit board 105. However, various types of elements of the electronic apparatus 100 which will be described later may be disposed on the circuit board 105.

The UI 120 includes a plurality of functional keys (not shown) through which a user sets or selects various types of functions supported in the electronic apparatus 100. The UI 120 also displays various types of information provided in the electronic apparatus 100. The UI 120 may be realized as a device which simultaneously realizes an input and an output like a touch screen or the like.

The storage 130 stores a program to drive the electronic apparatus 100. In detail, the storage 130 stores a program which is a set of various types of commands necessary to drive the electronic apparatus 100. Here, the program includes a Master Boot Record (MBR), an operating system (OS), and various types of applications.

The storage 130 may be realized as a storage medium (e.g., a flash memory, a hard disk drive (HDD), or the like) of the electronic apparatus 100 or an external medium (e.g., a removable disk including a universal serial bus (USB) memory, a storage medium connected to a host, or a web server through a network).

The controller 140 controls elements of the electronic apparatus 100. In detail, the controller 140 determines a control of the user, a control elapse time of the user, etc. to determine an operation mode of the electronic apparatus 100.

The controller 140 controls the elements of the electronic apparatus 100 so that the elements have operation states corresponding to the determined operation mode. In detail, the electronic apparatus 100 has a normal mode, a plurality of saving modes, and an off mode. Here, the normal mode refers to an operation mode which is to supply power to the elements of the electronic apparatus 100 in order to perform a process requested by the user. The save mode refers to an operation mode which is to block or minimize power supplied to a particular element to minimize power consumed in the electronic apparatus 100. The off mode refers to a state in which the electronic apparatus 100 does not operate. For example, the controller 140 may block power supplied to the antenna module 200 in the saving mode.

If a booting command is input, the controller 140 performs booting by using the OS stored in the storage 130. The controller 140 also performs a function corresponding to a user command input through the UI 120 after booting.

As described above, the electronic apparatus 100 communicates with the external apparatus by using the antenna module 200 which will be described later. Therefore, a size of the electronic apparatus 100 is reduced, and an efficient communication is possible.

In the present exemplary embodiment described with reference to FIG. 1, the electronic apparatus 100 includes one antenna module 200. However, the electronic apparatus 100 may include a plurality of antenna modules 200 which operate in different frequency bands.

Figure 2:
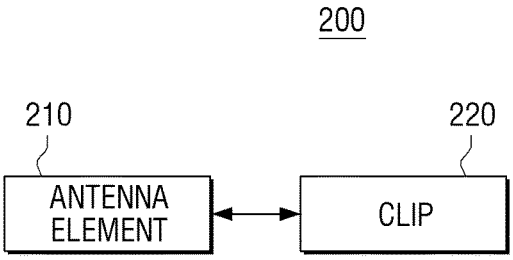
FIG. 2 is a block diagram illustrating a structure of an antenna module according to an exemplary embodiment of the present general inventive concept.
Figure 3:
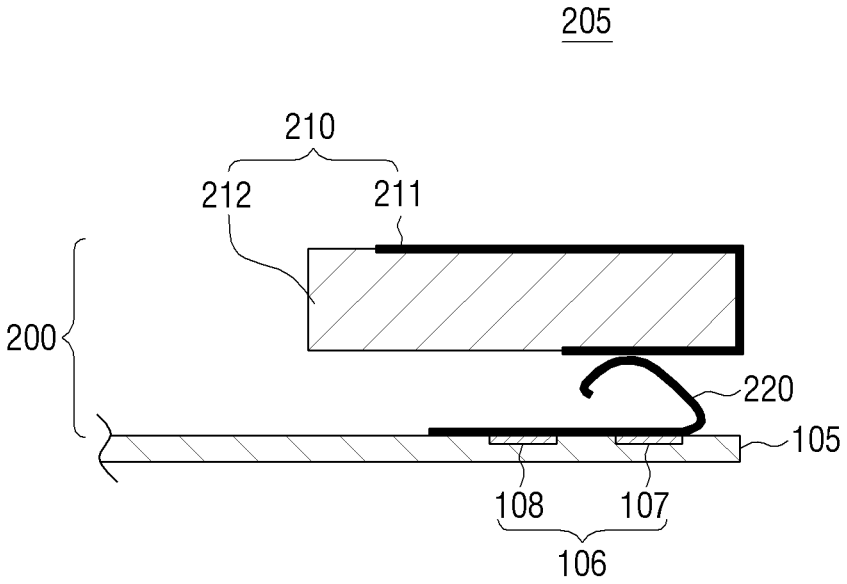
FIG. 3 is a view illustrating a shape of an antenna unit according to an exemplary embodiment of the present general inventive concept.

FIG. 2 is a block diagram illustrating a structure of an antenna module 200 according to an exemplary embodiment of the present general inventive concept. FIG. 3 is a view illustrating a shape of an antenna unit 205 according to an exemplary embodiment of the present general inventive concept.

The antenna module 200 according to the present exemplary embodiment may operate as two types. In detail, according to an exemplary embodiment of the present general inventive concept, the antenna module 200 resonates in a first frequency band. According to another exemplary embodiment, the antenna module 200 resonates in first and second frequency bands. In other words, according to an exemplary embodiment, a resonant frequency of an antenna is varied by using a clip of the antenna module 200. According to another exemplary embodiment, the antenna module 200 dually resonates by using the clip of the antenna module 200.

As described above, the antenna module 200 according to the present exemplary embodiment may operate as two types. This operation is determined by a connection form between the antenna module 200 and the circuit board 105, and the antenna module 200 has the same structure in the two exemplary embodiments. Therefore, a structure of the antenna module 200 will be first described, and operations of the antenna module 200 according to exemplary embodiments of the present general inventive concept will be described later. Herein, the combination of the antenna module 200 and the circuit board 105 may be referred to as an antenna unit 205.

Referring to FIGS. 2 and 3, the antenna module 200 includes an antenna element 210 and a clip 220.

The antenna element 210 emits an electromagnetic wave. In detail, the antenna element 210 includes a body block 212 and an antenna pattern 211 (hereinafter referred to as a first antenna pattern 211 for the descriptive convenience). The antenna element 210 may be a chip type dipole antenna.

The body block 212 may have a hexagonal shape. The body block 212 has a preset permeability or a preset dielectric constant. In other words, the body block 212 according to the present exemplary embodiment may be a ceramic body or a ferrite body. The body block 212 has the hexagonal shape in the present exemplary embodiment but may have other polygonal shapes. Also, the body block 212 may be formed of another material generally used to realize an antenna element, besides the ceramic body or the ferrite body.

The first antenna pattern 211 is formed on a surface of the body block 212. In detail, the first antenna pattern 211 emits an electromagnetic wave. The first antenna pattern 211 may be formed on a plurality of surfaces of the body block 212. The first antenna pattern 211 is illustrated as being formed on three surfaces of the body block 212 in FIG. 3 but may be formed on four surfaces of the body block 212 to enclose the body block 212 or may be formed on only one or two surfaces of the body block 212.

The clip 220 supplies power to the antenna element 210. In detail, the clip 220 is formed of a metallic material in a C shape and electrically connects the circuit board 105 of the interface 110 and the antenna element 210 to each other. Here, the metallic material may be copper (Cu), silver (Ag), gold (Au), or the like.

The clip 220 has an antenna pattern 222 (hereinafter referred to as a second antenna pattern for the descriptive convenience) at a lower part (in detail, a lower metal part) thereof connected to the circuit board 105.

Figure 4:
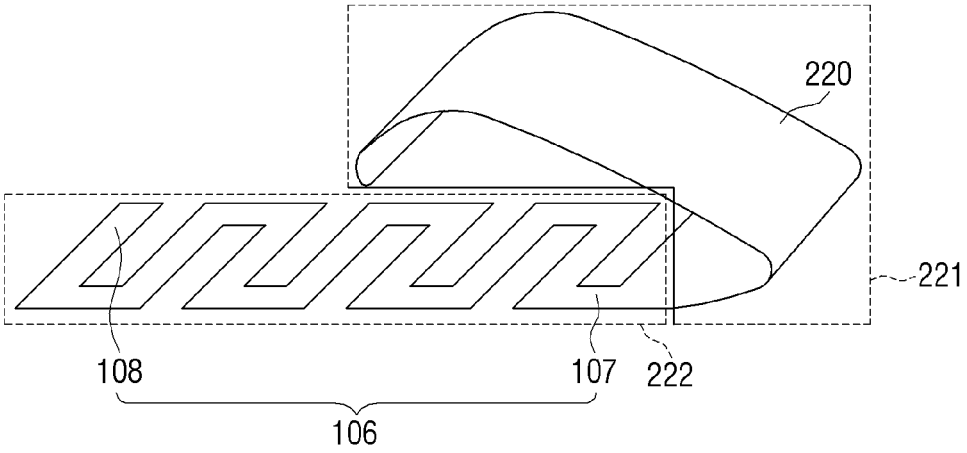
FIG. 4 is a view illustrating a shape of a clip of FIG. 3, according to an exemplary embodiment of the present general inventive concept.
Figure 5:
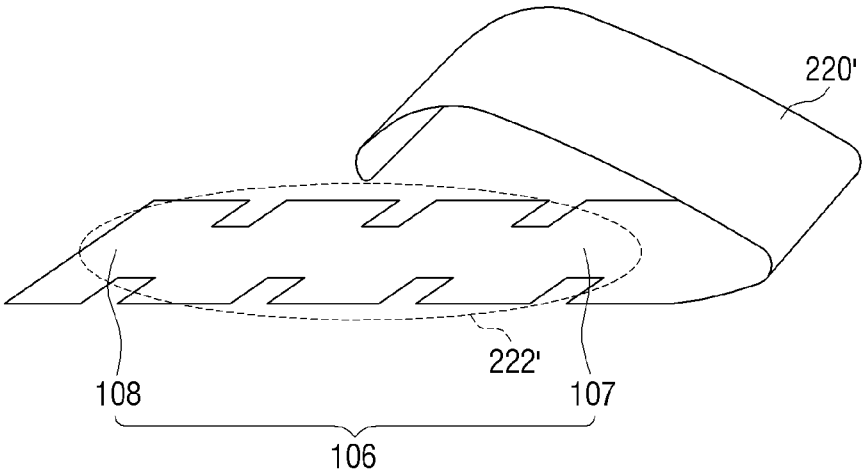
FIG. 5 is a view illustrating a shape of a clip according to another exemplary embodiment of the present general inventive concept.
Figure 6:
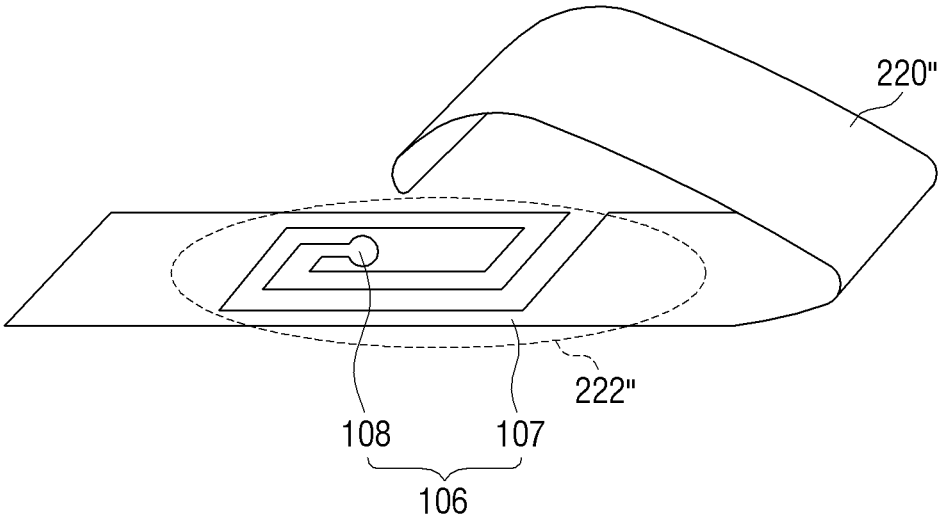
FIG. 6 is a view illustrating a shape of a clip according to another exemplary embodiment of the present general inventive concept.

The second antenna pattern 222 emits an electromagnetic wave and is formed at the lower part of the clip 220. In detail, the lower part of the clip 220 is cut to form the second antenna pattern 222 or a melted metallic material is put into a predetermined frame to form the second antenna pattern 222 so that the second antenna pattern 222 has a shape as shown in FIG. 4, 5, or 6.

A length of the second antenna pattern 222 may be $\lambda/4$ of a second frequency band (e.g., 5 GHz for example), where $\lambda$ is the wavelength. A shape of the second antenna pattern 222 will be described later with reference to FIGS. 4 through 6.

At least one end of the second antenna pattern 222 may be connected to the circuit board 105 at one of a plurality of connection positions 106, as illustrated in FIG. 3. In detail, the second antenna pattern 222 may be connected to the circuit board 105 at an outermost position 108 of the second antenna pattern 222, corresponding to the most distant position from the antenna element 210 along the clip 220. In this case, the antenna module 200 operates according to one exemplary embodiment. The second antenna pattern 222 may be connected to the circuit board at a position 107 adjacent to the second antenna pattern 222, corresponding to the closest position to the antenna element 210 along the clip 220. In this case the antenna module 200 operates according to another exemplary embodiment. The resonant frequency or frequencies of the antenna module 200 are affected by which of the connection positions 106 at which the second antenna pattern 222 is connected to the circuit board 105, as will be described below in regard to the exemplary embodiments of the present general inventive concept.

A basic structure of an antenna module 200 will now be described. It will be described with reference to this structure that the antenna module 200 operates according to an exemplary embodiment in which the second antenna pattern 222 is connected to the circuit board 105 at the most distant position from the antenna element 210 along the clip 220.

The circuit board 105 supplies power to the antenna module 200 in an outermost position 108 of the second antenna pattern 222. Therefore, a current supplied to the circuit board 105 is supplied to the first antenna pattern 211 through the second antenna pattern 222. In other words, the second antenna pattern 222 of the clip 220 has a function of increasing a length of the first antenna pattern 211.

Therefore, the antenna module 200 according to the present exemplary embodiment resonates in a first frequency band. Here, the first frequency band may be 2.4 GHz. In detail, a resonant frequency of the antenna module 200 corresponds to a total length of the first and second antenna patterns 211 and 222. The total length of the first and second antenna patterns 211 and 222 may be $\lambda/4$ of the first frequency band (e.g., 2.4 GHz), where $\lambda$ is a wavelength and the length of the first and second antenna patterns 211 and 222 is measured along their respective shapes.

The length of the first antenna pattern 211 may be realized as $\lambda/4$ of a third frequency band (e.g., 2.6 GHz), the third frequency band being higher than the first frequency band, and a length of the second antenna pattern 222 may be realized as $\lambda/4$ of a second frequency band (e.g., 5 GHz). The length of the second antenna pattern 222 may adaptively be set to the desired length of the first antenna pattern 211 or the desired resonant band of the first antenna pattern 211. For example, if a resonant frequency necessary for a system is 2.4 GHz, but the first antenna pattern 211 operates in a resonant band of 2.6 GHz, the second antenna pattern 222 may have enough length that the combination of the first antenna pattern 211 and the second antenna pattern 222 according to this exemplary embodiment operates in a resonant band of 2.4 GHz.

As described above, the antenna module 200 according to the present exemplary embodiment varies a band of the antenna element 210 by using a second antenna pattern 222 of the clip 220. Therefore, the antenna element 210 can be made small without affecting its performance.

The second antenna pattern 222 of the clip 220 may be disposed inside an antenna body (not shown), which in turn may be disposed inside a body (not shown) of the electronic apparatus 100. Therefore, an area of the second antenna pattern 222 exposed outside the body of the electronic apparatus 100 may be minimized, and thus an effect of external factors may be minimized.

The antenna module 200 which operates according to another exemplary embodiment of the present general inventive concept will now be described. In this exemplary embodiment, the second antenna pattern 222 is connected to the circuit board 105 at the closest position to the antenna element 210 along the clip 220.

The circuit board 105 supplies power to the antenna module 200 in a position 107 adjacent to the second antenna pattern 222. Therefore, a current supplied to the circuit board 105 flows in the first antenna pattern 211 or in the second antenna pattern 222 through the clip 220. In other words, the second antenna pattern 222 of the clip 220 resonates in a resonant frequency band different from the first antenna pattern 211 and separately from the first antenna pattern 211.

Therefore, the antenna module 200 according to the present exemplary embodiment resonates in two frequency bands. Here, a first frequency band may be 2.4 GHz, and a second frequency band may be 5 GHz. In detail, the antenna module 200 dually resonates in a resonant frequency corresponding to the length of the first antenna pattern 211 and in a resonant frequency corresponding to the length of the second antenna pattern 222.

From this viewpoint, the length of the first antenna pattern 211 may be realized as $\lambda/4$ of the third frequency band (e.g., 2.6 GHz), and the length of the second antenna pattern 222 may be realized as $\lambda/4$ of the second frequency band (e.g., 5 GHz).

As described above, the antenna module 200 according to the present exemplary embodiment supports separate frequency bands by using a second antenna pattern 222 of the clip 220 and thus dually resonates in a limited space, without the need for additional clips.

The second antenna pattern 222 of the clip 220 may be disposed inside an antenna body (not shown) which in turn may be disposed inside a body (not shown) of the electronic apparatus 100, and thus an area of the second antenna pattern 222 exposed outside the body of the electronic apparatus 100 may be minimized, thereby minimizing an effect of external factors.

Figure 7:
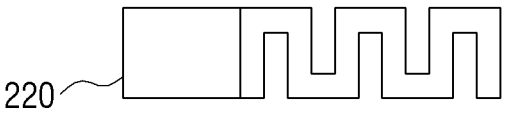
FIG. 7 is a view illustrating the clip of FIG. 4, according to an exemplary embodiment of the present general inventive concept.

FIGS. 4 through 6 are views illustrating shapes of the clip 220, according to exemplary embodiments of the present general inventive concept. FIG. 7 is a view illustrating the clip 220 of FIG. 4, according to an exemplary embodiment of the present general inventive concept.

Referring to FIGS. 4 and 7, the clip 220 has a meandering pattern having a plurality of bends on a surface thereof contacting the circuit board 105.

In detail, the clip 220 includes a structure area 221 physically connected to the antenna element 210 and the second antenna pattern 222.

The structure area 221 has a C shape and physically connects the antenna element 210 to the circuit board 105. An area of the structure area 221 is physically and electrically connected to the first antenna pattern 211 of the antenna element 210. The structure area 221 has only the C shape in the present exemplary embodiment but may be realized as any shape (e.g., a Z shape or a "ㄷ" shape, for example) which physically and electrically connects the antenna element 210 to the circuit board 105.

The second antenna pattern 222 has the meandering shape having the plurality of bends. The length of the second antenna pattern 222 governs which frequency the second antenna pattern 222 resonates in. More bends can be added to increase the length of the second antenna pattern 222, in order to change the corresponding resonant frequency. Similarly, bends can be removed to reduce the length of the second antenna pattern 222.

The connection positions 106 are disposed on the second antenna pattern 222, as illustrated in FIG. 4. The outermost position 108 of the second antenna pattern 222 corresponds to the most distant position from the antenna element 210 along the clip 220. The position 107 adjacent to the second antenna pattern 222 corresponds to the closest position to the antenna element 210 along the clip 220.

Referring to FIG. 5, a clip 220' has a "王"-shaped symmetrical pattern on the surface thereof contacting the circuit board 105. A second antenna pattern 222' is realized in the "王" shape in the present exemplary embodiment but may be realized in a meandering shape symmetrical based on a central axis.

Referring to FIG. 6, a clip 220" has a second antenna pattern 222" having a spiral shape on the surface thereof contacting the circuit board 105.

Only the meandering shape, the symmetrical shape, and the spiral shape are illustrated in the above-described exemplary embodiments. However, the second antenna pattern 222, 222', and 222" may be formed in other shapes besides the above-described shapes.

Figure 8:
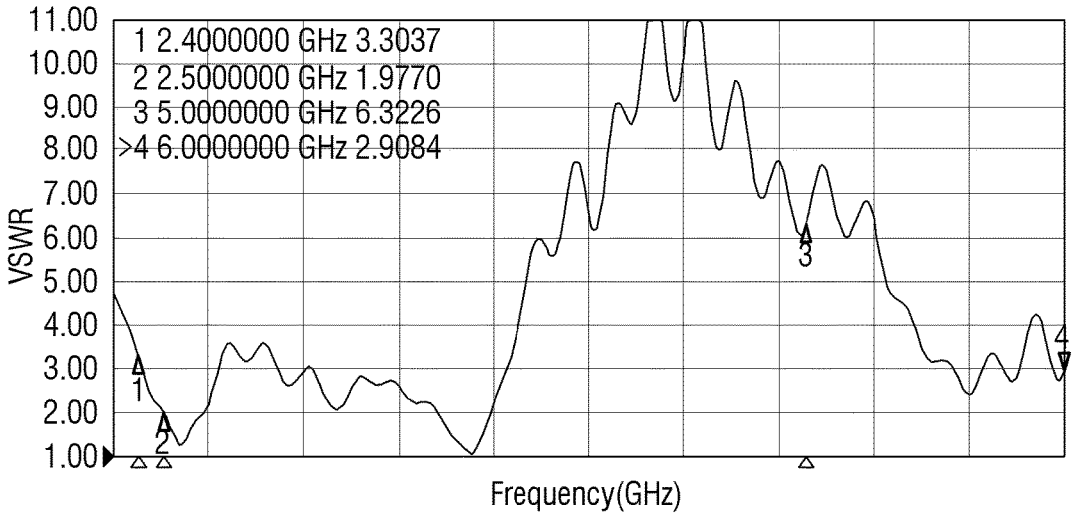
FIGS. 8 through 10 are graphs illustrating a performance of an antenna module according to an exemplary embodiment of the present general inventive concept.
Figure 9:
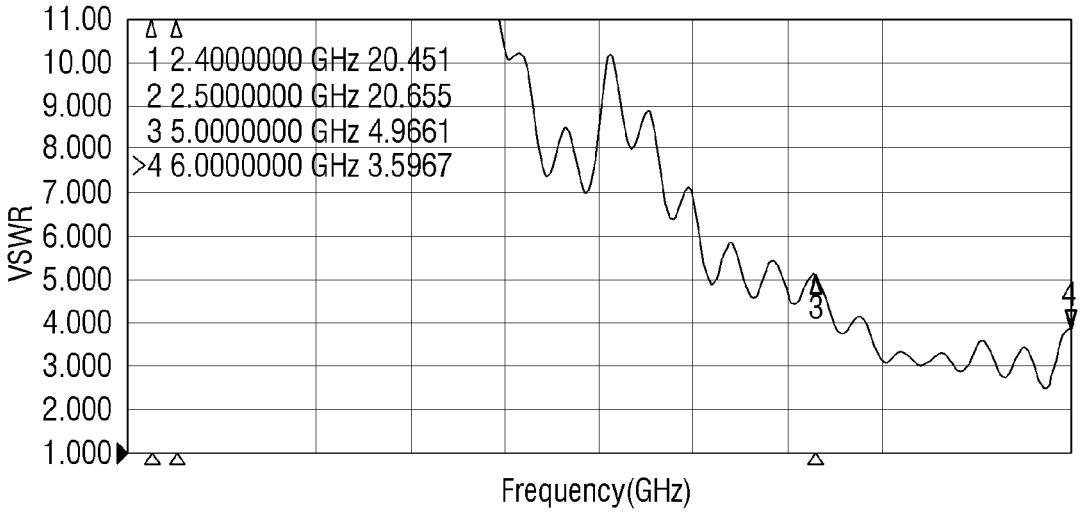
Figure 10:
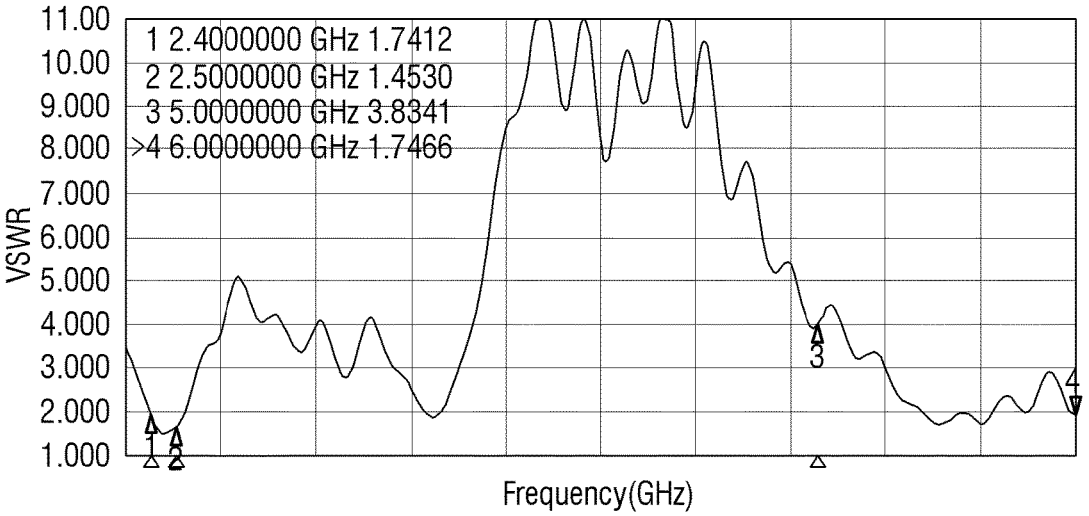

FIGS. 8 through 10 are graphs illustrating a performance of an antenna module 200 according to an exemplary embodiment of the present general inventive concept.

In detail, FIG. 8 is a graph illustrating a voltage standing wave ratio (VSWR) if a clip 220 not having a second antenna pattern 222 is used. FIG. 9 is a graph illustrating a VSWR if a clip 220 having the second antenna pattern 222 as shown in FIG. 4 is used according to an exemplary embodiment of the present general inventive concept in which the second antenna pattern 222 is connected to the circuit board 105 at the furthest position from the antenna element 210. FIG. 10 is a graph illustrating a VSWR if a clip 220 having the second antenna pattern 222 as shown in FIG. 4 is used according to another exemplary embodiment of the present general inventive concept in which the second antenna pattern 222 is connected to the circuit board 105 at the closest position to the antenna element 210. Here, the same antenna element 210 is used in FIGS. 8 through 10.

Referring to FIGS. 8 and 9, an antenna module 200 resonates in a frequency band having a whole resonance value of 2.6 GHz due to the limitation of a size of the antenna element 210. However, if a clip 220 having the second antenna pattern 222 illustrated in FIG. 4 according to the present exemplary embodiment is used, the antenna module 200, which normally resonates in a frequency band having a resonance value of 2.6 GHz due to the size of the antenna element 210, resonates in a desired frequency band of 2.4 GHz.

In other words, adding a second antenna pattern 222 to the antenna element 210 through clip 220 has the effect of inserting a parasitic resonator into a basic resonator through a coupling between a main antenna and a clip antenna to increase an antenna bandwidth.

Referring to FIG. 10, an antenna is designed to dually resonate in frequency bands of 2.4 GHz and 5 GHz. In detail, a VSWR in a corresponding frequency band will now be described. The VSWR is 1.7412:1 in a frequency band of 2.4 GHz, 1.4530:1 in a frequency band of 2.5 GHz, 3.8341:1 in a frequency band of 5 GHZ, and 1.7446 in a frequency band of 6 GHz. In other words, the VSWR is lower than or equal to 3 in a resonant frequency band. Therefore, an antenna using a contact point structure according to an exemplary embodiment of the present general inventive concept satisfies a performance as an antenna. A gain characteristic of the exemplary embodiment illustrated in FIG. 10 is shown in Table 1 below.

TABLE 1

| | Frequency (MHz) | | | | | | | | | | |
|---|---|---|---|---|---|---|---|---|---|---|---|
| | 2400 | 2442 | 2484 | 2500 | 5150 | 5250 | 5350 | 5470 | 5600 | 5725 | 5850 |
| Gain(dB) | −3.12 | −3.05 | −3.55 | −3.78 | −0.37 | −0.77 | −0.54 | −0.26 | −0.54 | −0.76 | −0.88 |
| eff.(%) | 48.75 | 49.54 | 44.17 | 41.88 | 91.91 | 83.74 | 88.28 | 94.21 | 88.22 | 83.93 | 81.74 |

Referring to Table 1, the antenna module 200 according to the present exemplary embodiment has an average gain of −3.5 dB in a frequency band of 2.4 GHz or −0.6 dB in a frequency band of 5 GHz. The antenna module 200 has efficiency of 40% or more in each frequency band. In other words, the antenna module 200 according to the present exemplary embodiment normally operates in each frequency band.

Figure 11:
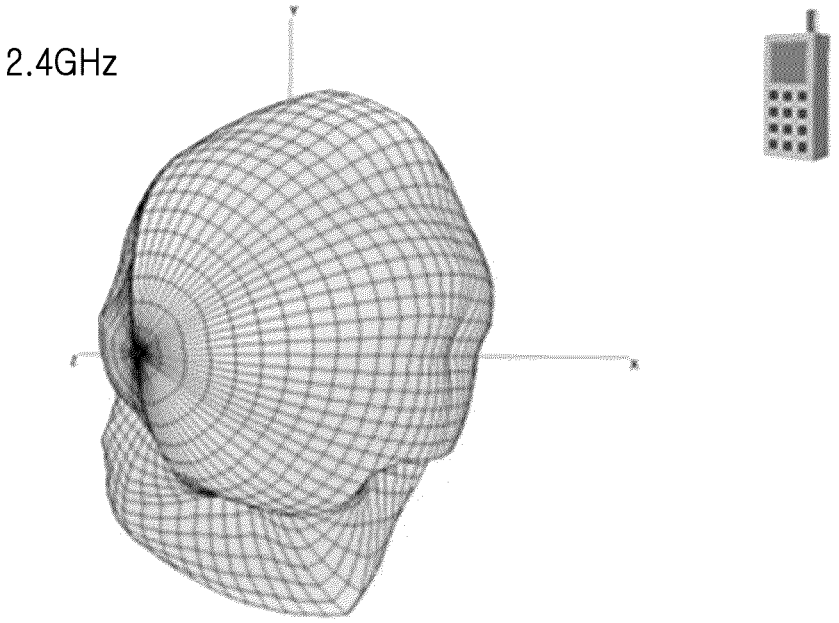
FIGS. 11 through 13 are views illustrating 3-dimensional (3D) radial patterns according to frequency bands.
Figure 12:
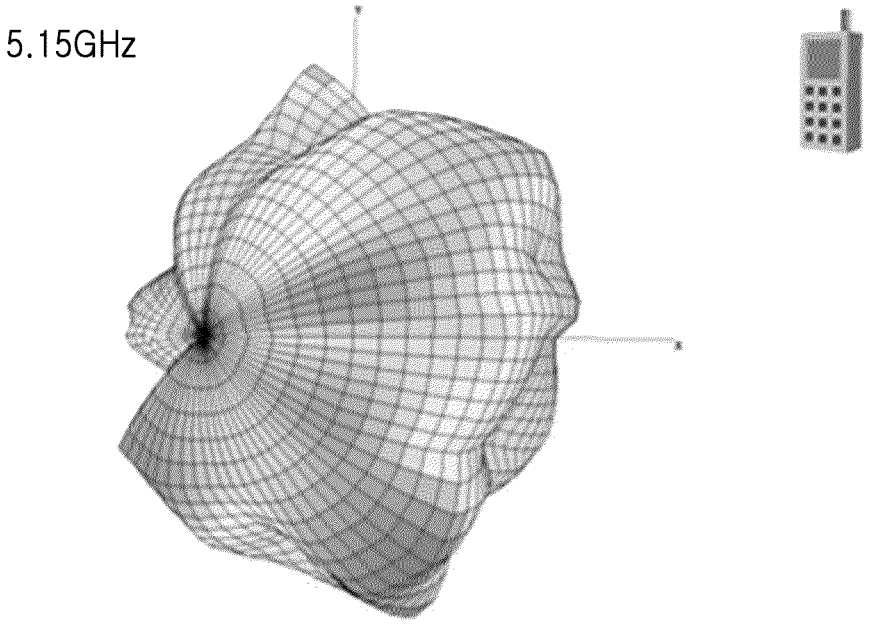
Figure 13:
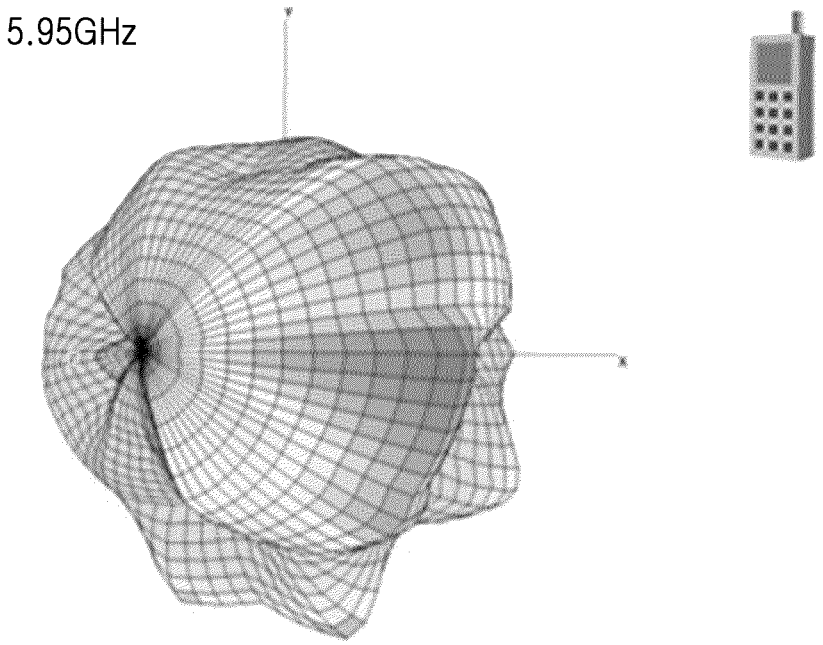

FIGS. 11 through 13 are views illustrating 3-dimensional (3D) radial patterns according to frequency bands.

Referring to FIGS. 11 through 13, an antenna module 200 according to exemplary embodiments of the present generally inventive concept operates normally in each frequency band.

Also, a first antenna pattern 211 having a frequency band of 5 GHz is designed in a feeding part not in an antenna body (not shown) to maintain a predetermined physical distance from a surface of a mobile communication terminal. Therefore, an antenna according to the present general inventive concept keeps a distance from a human body (not shown) to reduce a specific absorption rate (SAR), where the SAR corresponds to the rate at which energy is absorbed by the human body when exposed to a radio frequency electromagnetic field. Regulations on electronic devices, such as cellular phones, require that the SAR be kept to a minimum.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An antenna module comprising:

an antenna element which includes a first antenna radiator; and a C-shaped clip which includes a second antenna radiator, is formed of a metallic material, and electrically connects the first antenna radiator of the antenna element to a circuit board to process an antenna signal through the second antenna radiator, wherein the second antenna radiator has at least one of a meandering shape, a symmetrical line, and a spiral shape, and wherein the first antenna radiator resonates in a first frequency band, and the second antenna radiator resonates in a second frequency band which is different from the first frequency band.

2. The antenna module of claim 1, wherein the first frequency band is 2.4 GHz, and the second frequency band is 5 GHz.

3. The antenna module of claim 1, wherein the antenna element further includes:

a body block, wherein the first antenna radiator is formed on a surface of the body block and is connected to the clip.

4. The antenna module of claim 3, wherein the first antenna radiator is formed on a plurality of surfaces of the body block.

5. The antenna module of claim 3, wherein a total length of the first antenna radiator is ¼ times of a wavelength length of a first frequency band.

6. The antenna module of claim 1, wherein the first antenna radiator has a dipole antenna radiator.

7. The antenna module of claim 1, wherein the clip includes:

a plurality of connection positions which electrically connect the antenna element to the circuit board.

8. An electronic apparatus comprising:

a communication interface which includes an antenna module and a circuit board to communicate with an external apparatus through the antenna module, wherein the antenna module includes:

an antenna element which includes a first antenna radiator; and a C-shaped clip which includes a second antenna radiator, is formed of a metallic material, and electrically connects the first antenna radiator to the circuit board, wherein the second antenna radiator has at least one of a meandering shape, a symmetrical line, and a spiral shape, and wherein the first antenna radiator resonates in a first frequency band, and the second antenna radiator resonates in a second frequency band which is different from the first frequency band.

9. The electronic apparatus of claim 8, wherein the first frequency band is 2.4 GHz, and the second frequency band is 5 GHz.

10. The electronic apparatus of claim 8, wherein the antenna element further includes:

a body block, wherein the first antenna radiator is formed on a surface of the body block and is connected to the clip.

11. The electronic apparatus of claim 10, wherein the first antenna radiator is formed on a plurality of surfaces of the body block.

12. The electronic apparatus of claim 10, wherein a total length of the first antenna radiator is ¼ times of a wavelength length of a first frequency band.

13. The electronic apparatus of claim 8, wherein the first antenna radiator has a dipole antenna radiator.

14. An antenna unit comprising:

a circuit board; and an antenna module including:

an antenna element which includes a first antenna radiator; and a C-shaped clip which includes a second antenna radiator, is formed of a metallic material, and electrically connects the antenna element to the circuit board at least two connection positions to process an antenna signal through the second antenna radiator, wherein power is selectively supplied to the second antenna element through one of the at least two connection positions, and wherein the second antenna radiator has at least one of a meandering shape, a symmetrical line, and a spiral shape, and wherein the first antenna radiator resonates in a first frequency band, and the second antenna radiator resonates in a second frequency band which is different from the first frequency band.

* * * * *